US009828702B2

(12) United States Patent
Kawabe et al.

(10) Patent No.: US 9,828,702 B2
(45) Date of Patent: Nov. 28, 2017

(54) METHOD AND DEVICE FOR OPENING FIBER BUNDLE

(71) Applicants: FUKUI PREFECTURAL GOVERNMENT, Fukui-shi, Fukui (JP); HOKUSHIN CO., LTD, Fukui-shi, Fukui (JP); Shigeru Tomoda, Sakai-shi, Fukui (JP)

(72) Inventors: Kazumasa Kawabe, Fukui (JP); Shigeru Tomoda, Sakai (JP); Kenshiro Koizumi, Fukui (JP)

(73) Assignees: FUKUI PREFECTURAL GOVERNMENT, Fukui-shi, Fukui (JP); HOKUSHIN CO., LTD, Fukui-shi, Fukui (JP); Shigeru Tomoda, Sakaii-shi, Fukui (JP)

( * ) Notice: Subject to any disclaimer, the term of this patent is extended or adjusted under 35 U.S.C. 154(b) by 125 days.

(21) Appl. No.: 14/785,063

(22) PCT Filed: Apr. 19, 2013

(86) PCT No.: PCT/JP2013/061676
§ 371 (c)(1),
(2) Date: Oct. 16, 2015

(87) PCT Pub. No.: WO2014/171016
PCT Pub. Date: Oct. 23, 2014

(65) Prior Publication Data

US 2016/0083873 A1 Mar. 24, 2016

(51) Int. Cl.
*D02J 1/18* (2006.01)
*D02J 1/20* (2006.01)
(Continued)

(52) U.S. Cl.
CPC . *D02J 1/18* (2013.01); *D02J 1/20* (2013.01); *D04H 3/002* (2013.01); *D04H 3/004* (2013.01);
(Continued)

(58) Field of Classification Search
CPC ..... D02J 1/18; D02J 1/06; D02J 1/20; D01D 11/02; D04H 3/04; D04H 3/002; D04H 3/004; D02G 1/006
(Continued)

(56) References Cited

U.S. PATENT DOCUMENTS 3,636,825 A * 1/1972 Randall ..... A24D 3/0204 226/195
3,840,941 A * 10/1974 Neveu ..... B65H 51/005 28/220
(Continued)

FOREIGN PATENT DOCUMENTS

JP 61-275438 A 12/1986
JP 2000-226751 A 8/2000
(Continued)

OTHER PUBLICATIONS

International Search Report for PCT/jp2013/061676 dated May 21, 2013 [PCT/ISA/210].
(Continued)

*Primary Examiner* — Amy Vanatta
(74) *Attorney, Agent, or Firm* — Sughrue Mion, PLLC

(57) ABSTRACT

A method and a device for opening a fiber bundle, capable of performing a fluctuating operation, at a high speed, of pushing a part of a conveyed fiber bundle by a contact member into a stress state and then separating the contact member from the fiber bundle so as to temporarily relax the fiber bundle, and also capable of reducing damage to the fiber bundle. The device for opening a fiber bundle includes
(Continued)

a conveying portion 5 for pulling out a fiber bundle Tm from a yarn feeding body 11 and conveying it in a fiber length direction, a fiber-opening processing portion 3 for opening the fiber bundle by moving a fiber in a width direction while bending the fiber by letting a fluid pass through the conveyed fiber bundle Tm, and a fluctuation imparting portion 4 for rotating a contact member 42 in a direction inclined with respect to a conveyance direction while bringing it into contact with the conveyed fiber bundle Tm and pushing a part of the fiber bundle Tm into a stress state, and then separating the contact member 42 from the fiber bundle Tm in the stress state so as to temporarily bring the fiber bundle Tm into a relaxed state.

11 Claims, 9 Drawing Sheets

(51) Int. Cl.

| | |
|---|---|
| ***D01D 11/02*** | (2006.01) |
| ***D04H 3/002*** | (2012.01) |
| ***D04H 3/004*** | (2012.01) |
| ***D04H 3/005*** | (2012.01) |
| ***D04H 3/04*** | (2012.01) |

(52) U.S. Cl.
CPC ..... *D04H 3/005* (2013.01); *D04H 3/04* (2013.01); *D01D 11/02* (2013.01)

(58) Field of Classification Search
USPC ..... 28/282, 283
See application file for complete search history.

(56) References Cited

U.S. PATENT DOCUMENTS

| | | | | |
|---|---|---|---|---|
| 4,509,452 | A * | 4/1985 | Pryor | A24D 3/022 118/234 |
| 6,032,342 | A * | 3/2000 | Kawabe | D01G 9/08 226/97.4 |
| 2003/0057585 | A1* | 3/2003 | Tanaka | B29B 15/122 264/103 |
| 2006/0085958 | A1* | 4/2006 | Oishibashi | B65H 51/005 28/282 |
| 2006/0137156 | A1* | 6/2006 | Kawabe | B29C 70/20 28/271 |
| 2009/0271960 | A1 | 11/2009 | Kawabe et al. | |
| 2010/0107384 | A1* | 5/2010 | Meyer | D02J 1/18 28/282 |
| 2012/0135227 | A1* | 5/2012 | Kawabe | C08J 5/043 428/338 |
| 2015/0259832 | A1* | 9/2015 | Oosawa | D04H 3/002 28/282 |

FOREIGN PATENT DOCUMENTS

| | | | |
|---|---|---|---|
| JP | 2001-288639 | A | 10/2001 |
| JP | 2002-363855 | A | 12/2002 |
| JP | 2003-96638 | A | 4/2003 |
| JP | 2004-225222 | A | 8/2004 |
| JP | 2009-256870 | A | 11/2009 |
| JP | 2013-76193 | A | 4/2013 |
| WO | WO 2010/137525 | A1 * | 12/2010 |

OTHER PUBLICATIONS

Communication dated Nov. 18, 2016 from the European Patent Office in counterpart Application No. 13882554.2.

* cited by examiner

FIG. 3A
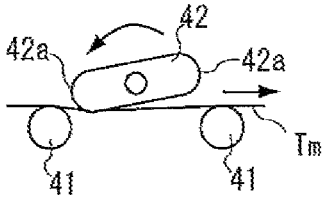
FIG. 3B
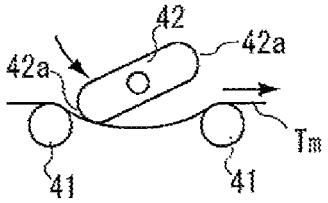
FIG. 3C
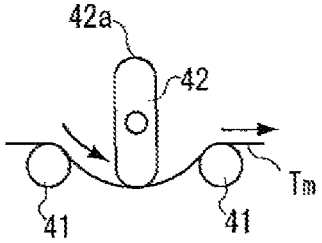
FIG. 3D
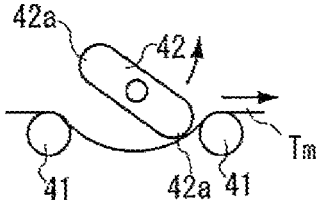
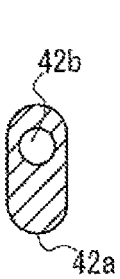
FIG. 4A
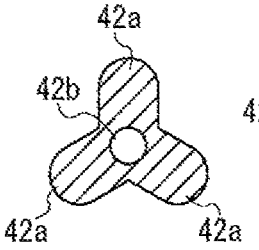
FIG. 4B
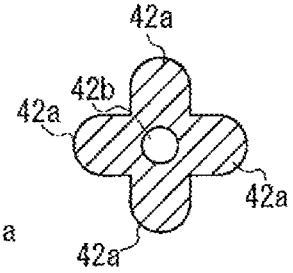
FIG. 4C
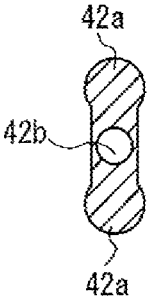
FIG. 4D

METHOD AND DEVICE FOR OPENING FIBER BUNDLE

CROSS REFERENCE TO RELATED APPLICATIONS

This application is a National Stage of International Application No. PCT/JP2013/061676, filed on Apr. 19, 2013, the contents of all of which are incorporated herein by reference in their entirety.

TECHNICAL FIELD

The present invention relates to a method and a device for opening a fiber bundle by conveying a fiber bundle made of a large number of fibers in a fiber length direction and moving the fibers in a width direction while bending the fibers by letting a fluid pass through the fiber bundle.

BACKGROUND ART

A fiber-reinforced composite material in which reinforced fibers such as a carbon fiber, a glass fiber, and an aramid fiber and a matrix resin such as an epoxy resin are combined has been developed, and regarding such reinforced fibers, by laminating thin fiber sheets aligned in one direction in multiple directions for use, composite materials with excellent dynamic characteristics can be obtained.

Thus, a technology for aligning, in one direction, the fiber bundle in which a predetermined number of the reinforced fibers are bundled and opening the fiber bundle into a sheet state has been developed. For example, Patent Literature 1 describes a method for opening a reinforced fiber bundle, which, after striking the continuously running reinforced fiber bundle, opens the fiber bundle by using a laterally vibrating roll vibrating in a roll axis direction and/or a vertically vibrating roll vibrating in a vertical direction with respect to a running direction of the reinforced fiber bundle. Patent Literature 2 describes a method for opening a reinforced fiber bundle, which opens a continuously running reinforced fiber bundle by using a lateral vibration imparting roll vibrating in a direction of the reinforced fiber bundle width direction and/or a vertical vibration imparting roll vibrating in a direction crossing the running direction of the reinforced fiber bundle and blows an air flow to a surface on one side and a surface on the other side of a running surface of the reinforced fiber bundle so as to open the reinforced fiber bundle by untangling it. Moreover, Patent Literature 3 describes a fiber opening device which pulls out and supplies fiber bundles from a plurality of yarn feeding bodies, respectively, causes the supplied fiber bundles to run through air flows in a plurality of fluid flowing portions so as to open them in a width direction while bending the fiber bundles by an action of the air flows and by locally bending/stretching the fiber bundles moving at that time so as to alternately and repeatedly change a tension such as stress, relaxation, stress, relaxation and the like.

CITATION LIST

Patent Literature

PTL 1: JP 2004-225222 A
PTL 2: JP 2005-163223 A
PTL 3: JP 2007-518890 W

SUMMARY OF INVENTION

Technical Problem

In the aforementioned Patent Literatures, the fiber bundle is efficiently opened by imparting vertical vibration to the running fiber bundle from the direction orthogonal to the running direction or by imparting lateral vibration to the width direction of the running fiber bundle.

However, if a running speed of the fiber bundle has been increased in order to improve production efficiency, a speed of a driving mechanism for imparting the vertical vibration and the lateral vibration also needs to be increased. If the vertical vibration speed is increased, members for imparting the vibration to the fiber bundle collide against each other at a high speed, and there is a problem that damage given to the fiber bundle becomes large.

Particularly, in the fiber opening device described in Patent Literature 3, as a method of vertical vibration for bending/stretching the fiber bundle, a pressing roll is elevated up/down and the pressing roll is made to collide against the fiber bundle. In this method, a favorable fiber-opening effect can be obtained at a predetermined conveyance speed for making the fiber bundle run. However, if the conveyance speed increases, an elevating speed of the pressing roll should be increased and thus, a tension of the fiber bundle instantaneously becomes large, and fibers are likely to be cut. Such rapid fluctuation of the tension in the fiber bundle becomes a factor to generate contraction of a fiber-opening width which makes the fiber-opening width unstable and to cause meandering of the fibers. Moreover, the rapid fluctuation in the tension of the fiber bundle gives a bad influence to the device for supplying the fiber bundle to the fiber-opening device such as occurrence of a trouble in supply from the yarn feeding body. Furthermore, if a device for impregnating the fiber-opened sheet treated by the fiber-opening device with a resin is installed, it gives a bad influence that the resin cannot be uniformly impregnate easily.

Moreover, with expansion of the fiber-opening width of the fiber bundle, a size of a member for imparting the vertical vibration and the lateral vibration corresponding to the fiber-opening width needs to be increased, a driving mechanism for driving the large and heavy member becomes large, and there is a problem that a space required for driving the member becomes large to increase a size of the device.

Thus, the present invention has an object to provide a method and a device for opening a fiber bundle which can execute fiber-opening processing at a high speed while reducing damage given to the fiber bundle.

Solution to Problem

A method for opening a fiber bundle according to the present invention is the one for opening a fiber bundle by pulling out the fiber bundle from a yarn feeding body and conveying the fiber bundle in a fiber length direction and by moving a fiber in a width direction while bending the fiber by letting a fluid pass through the fiber bundle to be conveyed, the method including the step of repeatedly performing a fluctuating operation of moving a contact member in a direction inclined at least with respect to a conveyance direction while bringing it into contact with the fiber bundle to be conveyed so as to push a part of the fiber bundle into a stress state, and then separating the contact member from the fiber bundle in the stress state so as to temporarily bring the fiber bundle into a relaxed state. Moreover, an angle between a moving direction of a contact surface of the contact member and a running direction of the fiber bundle at a moment when the contact member is brought into contact with the fiber bundle is set to an angle smaller than 90 degrees. Moreover, the fluctuating operation is performed by rotating the contact member. Moreover, when the contact member moves in contact with the fiber bundle, a contact portion moves at a speed faster than a speed at which the fiber bundles run. Moreover, when an arbitrary spot of the fiber bundle is conveyed in a passage region of the fluid, at least one session of the fluctuating operation is performed. Moreover, the fluctuating operation is performed on the fiber bundle in the passage region of the fluid. Moreover, the passage regions are set at a plurality of spots in a conveying path of the fiber bundle. Moreover, the contact member is operated by adjusting contact timing of a plurality of the contact members disposed corresponding to the passage region.

A device for opening a fiber bundle according to the present invention includes: a conveying portion for pulling out a fiber bundle from a yarn feeding body and conveying the fiber bundle in a fiber length direction; a fiber-opening processing portion for opening the fiber bundle by moving a fiber in a width direction while bending the fiber by letting a fluid pass through the fiber bundle to be conveyed; and a fluctuation imparting portion for moving a contact member in a direction inclined at least with respect to a conveyance direction while bringing it into contact with the fiber bundle to be conveyed so as to push a part of the fiber bundle into a stress state and then, separating the contact member from the fiber bundle in the stress state so as to temporarily bring the fiber bundle into a relaxed state. Moreover, the fluctuation imparting portion rotates the contact member. Moreover, a rotary shaft is provided in the contact member. Moreover, contact surfaces in contact with the fiber bundle to be conveyed are formed at a plurality of spots in the contact member. Moreover, the fluctuation imparting portion is disposed in the fiber-opening processing portion. Moreover, the contact member includes a width regulating portion for regulating a width of the fiber bundle to be conveyed.

Advantageous Effects of Invention

The present invention has a constitution as described above and since when the fluctuating operation of pushing a part of the fiber bundle to be conveyed by the contact member into the stress state, and then separating the contact member from the fiber bundle so as to temporarily bring the fiber bundle into a relaxed state is performed, the contact member is moved in the direction inclined at least with respect to the conveyance direction and pushing a part of the fiber bundle into the stress state while bringing the contact member into contact with the fiber bundle to be conveyed and thus, the contact member is brought into contact with the fiber bundle as if stroking it and damage given to the fiber bundle when the contact member is brought into contact can be reduced. Thus, even when the fluctuating operation is performed by operating the contact member at a high speed corresponding to a speed increase of the fiber-opening processing, it becomes possible to perform the high-quality fiber-opening processing while suppressing damage given to the fiber bundle.

Here, the conveyance direction of the fiber bundle means a direction of a conveying path of the fiber bundle to be conveyed, and means a direction in which the fiber bundle is stretched in a conveying path when the conveying path is regulated by a guide member such as a guide roll.

BRIEF DESCRIPTION OF DRAWINGS

FIGS. 3A-3D are explanatory views relating to a rotating operation of the contact member.

FIGS. 4A-4D are sectional views relating to a variation of the contact member.

DESCRIPTION OF EMBODIMENTS

Embodiments according to the present invention will be described below in detail. The embodiments described below are preferred embodiments in implementing the present invention and have various technical limitations, but the present invention is not limited by these modes unless particularly specified otherwise in the following description.

Figure 1A:
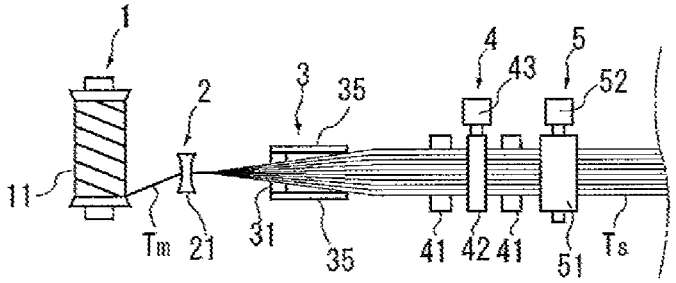
FIG. 1A is a schematic plan view relating to a device for opening a fiber bundle according to the present invention.
Figure 1B:
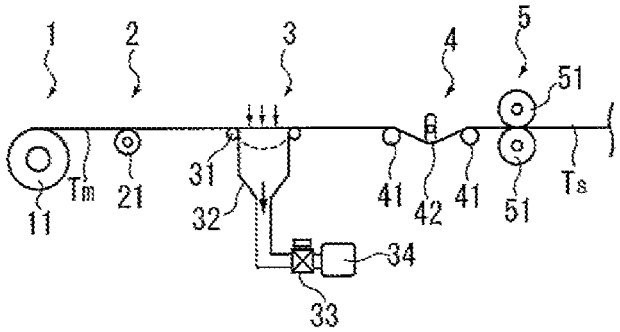
FIG. 1B is a schematic side view relating to the device for opening a fiber bundle according to the present invention.

FIGS. 1A and 1B are a schematic plan view (FIG. 1A) and a schematic side view (FIG. 1B) relating to a device for opening a fiber bundle according to the present invention. This device example includes a yarn feeding portion 1 for feeding a fiber bundle Tm, a guide portion 2 for guiding the fed fiber bundle Tm, a fiber-opening processing portion 3 for opening the conveyed fiber bundle Tm, a fluctuation imparting portion 4 for performing a fluctuating operation of pushing a part of the conveyed fiber bundle Tm by a contact member into a stress state, and then separating the contact member so as to temporarily relax it, and a conveying portion 5 for sandwiching and pulling in an opened yarn sheet Ts.

The fiber bundle Tm bundling a plurality of long fibers is wound around a bobbin-type yarn feeding body 11, and as the opened yarn sheet Ts is pulled in by the conveying portion 5 at a predetermined conveyance speed, the yarn feeding body 11 rotates and the fiber bundle Tm is fed out. The fed-out fiber bundle Tm is, as will be described later, guided by a guide member such as a guide roll 21 of the guide portion 2, a guide roll 31 of the fiber-opening processing portion 3, and a guide roll 41 of the fluctuation imparting portion 4 and conveyed. By means of these guide members, a conveying path of the fiber bundle Tm is defined, and a direction in which the fiber bundle Tm is stretched by the guide member becomes a conveyance direction. In this example, the conveyance direction is set linearly to a right-and-left direction in FIG. 1B. In an actual running state of the fiber bundle Tm, a part of the fiber bundle runs while being bent as will be described later, and a running direction of the fiber bundle Tm fluctuates with respect to the conveyance direction. Moreover, the conveyance speed is a speed at which the opened yarn sheet Ts is pulled in by the conveying portion 5, and as will be described alter, the actual running speed of the fiber bundle Tm fluctuates such as to be locally and instantaneously faster or slower than the conveyance speed by an operation of the fluctuation imparting portion 4.

As a fiber material used for the fiber bundle Tm, a reinforced fiber bundle made of a high-strength fiber such as a carbon fiber bundle, a glass fiber bundle, an aramid fiber bundle, and a ceramic fiber bundle, a thermoplastic resin fiber bundle in which thermoplastic synthetic fibers such as polyethylene, polypropylene, nylon 6, nylon 66, nylon 12, polyethylene terephthalate, polyphenylene sulfide, and polyetheretherketon are aligned can be cited. Regarding the number of bundled fiber bundles, in the case of the carbon fiber bundle, for example, those with the number of fibers of 12000 to 24000 are mainly used but in the present invention, a fiber bundle having the number of bundled fibers exceeding 24000 (48000, for example) can be also used.

The fiber bundle Tm fed out of the yarn feeding body 11 is pulled out by the guide roll 21 of the guide portion 2 in a predetermined pulling-out direction.

The pulled-out fiber bundle Tm passes through the fiber-opening processing portion 3 disposed in the conveying path. The fiber-opening processing portion 3 supports the fiber bundle Tm by a pair of the guide rolls 31 arrayed in the conveyance direction. A wind tunnel pipe 32 is provided between the guide rolls 31, and an upper opening portion of the wind tunnel pipe 32 is formed having a predetermined width between the guide rolls 31. A flow control valve 33 and an air intake pump 34 are mounted on a lower side of the wind tunnel pipe 32, and by operating the air intake pump 34 so as to suction air in the wind tunnel pipe 32, a downward air flow is generated by suctioning in the upper opening portion between the guide rolls 31. Thus, in this example, a space between the guide rolls 31 is set to a passage region of a fluid.

If the suctioned airflow passes through the fiber bundle Tm being conveyed between the guide rolls 31, the fiber bundle Tm is brought into a bent state by a flow velocity of the air flow. When the air flow passes through the space among the fibers of the fiber bundle Tm in the bent state, a force to move the fibers in the width direction of the fiber bundle Tm acts, and the fiber bundle Tm is opened. Such a fiber-opening action is known. In this example, the fiber-opening processing is performed by using the air flow, but the fiber-opening processing may be performed by using a liquid such as water as a fluid.

A pair of the guide members 35 are mounted on both sides of the upper opening portion of the wind tunnel pipe 32 along the conveyance direction, and when the fiber bundle is opened by passage of the suctioned air flow through the fiber bundle Tm being conveyed between the guide rolls 31, a fiber-opening width is defined by the guide member 35.

In the guide member 35, the upper opening portions of the wind tunnel pipe 32 may be formed having a rectangular shape so that side walls of the opening portion may be used as it is. Alternatively, a plurality of wires or the like may be erected upright inside the wind tunnel pipe 32 so as to be used as guide members.

Figure 2:
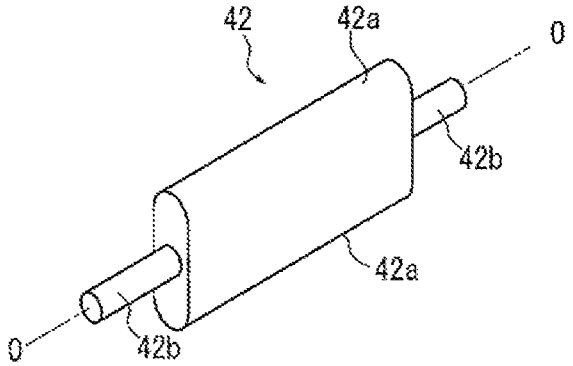
FIG. 2 is an appearance perspective view relating to a contact member.

The opened fiber bundle Tm passes through the fluctuation imparting porting 4 disposed in the conveying path. The fluctuation imparting portion 4 supports the fiber bundle Tm by the pair of guide rolls 41 arrayed in the conveyance direction. A contact member 42 is disposed in the space between the guide rolls 41. The contact member 42 is disposed on a side opposite to the guide rolls 41 with respect to the fiber bundle Tm to be conveyed and its length is set to a length capable of being in contact with the whole width of the opened fiber bundle Tm in the width direction. FIG. 2 is an appearance perspective view relating to the contact member 42. The contact member 42 is formed into a plate-shaped body having a predetermined thickness and a support shaft 42*b* is provided so as to protrude to both sides along a center axis O set in a longitudinal direction. Then, a pair of contact surfaces 42*a* are formed at side portions on both side ends set in parallel at a predetermined interval from the center axis O. The contact surface 42*a* is formed into a curved shape, and a cut section in a direction orthogonal to the center axis O is formed into an arc shape.

One of the support shafts 42*b* of the contact member 42 is pivotally supported rotatably, while a driving motor 43 is connected/fixed to the other. Then, a driving shaft of the driving motor 43 and the center axis of the contact member 42 are connected so as to match each other. By rotating/driving the driving motor 43, the contact member 42 rotates around the center axis. In this case, a direction in which the fiber bundle is stretched between the pair of guide rolls 41 becomes the conveyance direction (right-and-left direction in FIG. 1B), and the contact member 42 rotates so as to move in a direction inclined with respect to the conveyance direction while contacting with the fiber bundle Tm. Thus, by means of the rotating operation of the contact member 42, the contact surfaces 42*a* on the both side ends act such that the contact surfaces 42*a* on the both side ends alternately push in the fiber bundle Tm between the guide rolls 41 into the stress state.

FIG. 3 is an explanatory view relating to the rotating operation of the contact member 42. First, in a state in which the contact surface 42*a* of the contact member 42 is not in contact with the fiber bundle Tm, the fiber bundle Tm is guided by the guide rolls 41 in the conveyance direction and is conveyed in a state close to a plane (since the figure is a side view, it becomes linear). In this example, the fiber bundle Tm is conveyed from left to the right direction in the conveyance direction. The contact member 42 rotates counterclockwise, and one of the contact surfaces of the contact member 42 is brought into contact with an upper surface of the fiber bundle Tm (FIG. 3A). The contact member 42 further rotates from the state in FIG. 3A, and the contact surface 42*a* moves in a direction inclined with respect to the conveyance direction while contacting with fiber bundle Tm and pushes in the fiber bundle Tm (FIG. 3B). At a moment when the fiber bundle Tm is brought into contact with the contact surface 42*a*, an angle between a rotating direction of the contact surface 42*a* and the actual running direction of the fiber bundle Tm is smaller than 90 degrees. Thus, damage at the moment when the contact member 42 is brought into contact with the fiber bundle Tm can be reduced.

In this example, a rotation speed of the contact member 42 is set so that a circumferential speed at a tip end portion of the contact surface 42*a* is larger than an actual running speed of the fiber bundle Tm. Thus, the contact surface 42*a* is brought into contact with the surface of the fiber bundle Tm along the fiber bundle Tm as if stroking the surface and rotates while shifting. Therefore, the contact surface 42*a* moves while contacting the fiber bundle Tm. At that time, since it rotates while pushing in the fiber bundle Tm, the fiber bundle Tm is pulled in mainly from an upstream side and enters the stress state in which the length of the fiber bundle Tm between the guide rolls 41 becomes longer than an interval between the guide rolls 41 due to the pushing-in associated with the rotation of the contact surface 42*a*.

By means of the rotation of the contact member 42, the contact surface 42*a* is gradually pushed deep into the fiber bundle Tm and enters the stress state in which the fiber bundle Tm is pushed into the deepest (FIG. 3C). In this state, the length of the fiber bundle Tm pushed between the guide rolls 41 is the longest. The contact surface 42*a* is moved in the direction inclined with respect to the conveyance direction while contacting the fiber bundle Tm and by the time it enters the state in which the fiber bundle Tm is pushed into the deepest, the contact surface 42*a* has rotated in contact with the fiber bundle Tm as if stroking it, and as compared with the fluctuating operation of linearly moving the contact member in a direction orthogonal to the conveyance direction with respect to the fiber bundle Tm as in a prior-art technology, damage given while in contact with the fiber bundle Tm can be drastically reduced.

The contact member 42 further rotates from the stress state in which the fiber bundle Tm is pushed into the deepest and the contact surface 42*a* begins to rotate upward, and the contact surface 42*a* is separated from the fiber bundle Tm (FIG. 3D). That is, if a speed of returning to an original planar state from the state in which the fiber bundle Tm is pushed in is slower than a vertically rising speed of the contact surface 42*a*, the contact surface 42*a* is separated from the fiber bundle Tm.

When the contact surface 42*a* is separated from the fiber bundle Tm, the fiber bundle Tm seeks to return to the original planar state from the pushed-in state, but at a moment when the contact surface 42*a* is separated, the fiber bundle Tm between the guide rolls 41 in the pushed-in state is longer than an interval between the guide rolls 41. Thus, for a short period of time until the pushed-in state is solved, the fiber bundle Tm is temporarily brought into a relaxed state.

The temporary relaxed state of the fiber bundle Tm generated as above temporarily lowers a tension of the fiber bundle Tm opened by the fiber-opening processing portion 3. Thus, by repeating the fluctuating operation of contacting and separating the contact member 42 with respect to the fiber bundle Tm as described above, at each moment when the contact member 42 is separated from the fiber bundle Tm (the fiber bundle Tm is in the relaxed state), the fiber bundle Tm is largely bent in a passage direction of the fluid in the passage region of the fluid of the fiber-opening processing portion 3. Therefore, the fiber-opening processing of the fiber bundle Tm by the passage of the fluid can be efficiently performed.

As described above, by bringing only the contact surface 42*a* at the tip end portion of the contact member 42 into contact with the fiber bundle Tm and pushing it in and then, by separating the contact member 42 from the fiber bundle Tm, at the moment when the contact member 42 is separated, the fiber bundle Tm is largely bent in the fiber-opening processing portion 3, and favorable fiber-opening processing can be performed.

If the speed of the fiber-opening processing is to be increased, since passage time of the fiber bundle Tm becomes short in the fiber-opening processing portion 3, the fiber-opening efficiency needs to be improved. In the fiber-opening processing portion 3, when the fluid acts on the fiber bundle Tm to bring it into a bent state, by lowering the tension applied to the fiber bundle Tm as low as possible, it is possible to improve the fiber-opening efficiency.

Passage time t (minute) of the fiber bundle Tm in the fiber-opening processing portion 3 is calculated by the following expression, assuming that a conveyance speed of the fiber bundle Tm is V (m/minute) and a length of the wind tunnel pipe of the fiber-opening processing portion 3 in the conveyance direction is W (m):

$$t=W/V$$

Then, by creating a state in which an arbitrary spot of the fiber bundle Tm is subjected to at least one session of the fluctuating operation when being conveyed in the fiber-opening processing portion 3, and the contact surface of the contact member is separated from the fiber bundle Tm, tension of the arbitrary spot of the fiber bundle Tm is lowered, and the entire fiber bundle Tm is uniformly subjected to the fiber-opening processing, whereby the fiber-opening efficiency can be improved. The number of sessions n (times/minute) of the fluctuating operation for the arbitrary spot of the fiber bundle Tm to be subjected to at least one session of the fluctuating operation is calculated by the following expression:

$$n=1/t=V/W$$

Therefore, if the speed of the fiber-opening processing is to be increased by increasing the conveyance speed of the fiber bundle Tm, it is necessary to improve the fiber-opening efficiency by increasing the number of sessions of the fluctuating operation per unit time. If the fiber bundle Tm is conveyed while passing through a plurality of the fiber-opening processing portions 3, by subjecting the arbitrary spot of the fiber bundle Tm to at least one session of the fluctuating operation during conveyance in any of the fiber-opening processing portions 3, the entire fiber bundle Tm is subjected to the fiber-opening processing while being uniformly subjected to the fluctuating operation.

In this embodiment, since the contact member 42 is configured to be rotated by rotation/driving by the driving motor 43, if the conveyance speed of the fiber bundle Tm is to be increased, it is only necessary to increase the number of sessions of the fluctuating operation per unit time by rotating the contact member 42 at a high speed, and speed-up of the fiber-opening processing can be easily handled. Even if the contact member 42 is rotated at a high speed, damage when it is brought into contact with the fiber bundle Tm can be reduced, and the stable fluctuating operation can be performed.

As illustrated in FIG. 3D, after one of the contact surfaces 42*a* is separated, the other contact surface 42*a* is brought into contact with the fiber bundle Tm, but if the rotation speed of the contact member 42 is large, the contact surface 42*a* is brought into contact before the fiber bundle Tm returns to the original stretched state. In this case, too, since the contact surface 42*a* moves in the direction inclined with respect to the conveyance direction while in contact with the fiber bundle Tm, the similar fluctuating operation can be performed, and the speed-up of the rotation speed of the contact member 42 can be sufficiently handled. The angle between the moving direction of the contact surface 42*a* and the running direction of the fiber bundle Tm at the moment when the contact surface 42*a* of the contact member 42 is brought into contact with the fiber bundle Tm becomes an angle smaller than that in the state in which the fiber bundle Tm is stretched (FIG. 3A), and the damage given to the fiber bundle Tm at the moment when the contact member 42 is brought into contact can be further reduced.

Moreover, when a fiber-opening width of the fiber bundle is to be expanded, the length of the contact member 42 needs to be set longer in accordance with the fiber-opening width, but even if the length of the contact member 42 becomes longer, the fluctuating operation can be performed stably, and production efficiency of the fiber-opening processing can be improved.

Then, since the contact member is moved in the direction inclined with respect to the conveyance direction while in contact with the fiber bundle Tm, an impact force given to the fiber bundle Tm is smaller than that in the case of the fluctuating operation of linearly moving the contact member in the direction orthogonal to the conveyance direction as before, and fiber break or meandering of the fiber bundle becomes difficult to occur, whereby a high-quality fiber sheet can be obtained. That is, in order to efficiently perform the fiber-opening processing by the fluctuating operation, an amount of the fiber bundle Tm to be pulled in between the guide rollers 41 in the fluctuating operation is important, and thus, a pushed-in depth of the fiber bundle Tm by the contact member needs to be made deeper in accordance with the pulled-in amount of the fiber bundle Tm. When the contact member is moved in the direction inclined with respect to the conveyance direction so as to push the fiber bundle Tm into the predetermined depth, damage to be given to the fiber bundle Tm can be drastically reduced as compared with the case in which the contact member is linearly moved in the direction orthogonal to the conveyance direction and pushed into the same depth, and the difference is remarkable when the speed of the fluctuating operation is increased.

Moreover, the contact surface 42*a* is moved while in contact with the fiber bundle Tm and is brought into contact with the fiber bundle Tm as if stroking its surface during the period until it is separated from the fiber bundle Tm and thus, the length in contact with the fiber bundle Tm can be set longer than the case of linear movement in the direction orthogonal to the conveyance direction as in the prior-art technology. In the state in which the contact member 42 is in contact with the fiber bundle Tm, the contact surface 42*a* is in pressure-contact with the surface of the fiber bundle Tm, and if the fiber in the fiber bundle Tm floats from the surface, for example, the contact surface acts to push in the fiber between the fibers and to uniformly array the fibers. Thus, since the length of the fiber bundle in contact with the contact member 42 becomes longer, the fibers of the fiber bundle Tm are aligned and distribution performances can be improved.

In this case, when the contact surface 42*a* moves while in contact with the fiber bundle Tm, since it moves in the direction inclined at least with respect to the conveyance direction, the fiber bundle Tm can be pushed in with less damage. The phrase "moving in the direction inclined at least with respect to the conveyance direction" means that the moving direction of the contact surface 42*a* becomes a direction inclined with respect to the conveyance direction in the whole period or a part of the period during which the fiber bundle Tm is pushed in.

In the example described above, at the moment when the contact member 42 is brought into contact with the fiber bundle Tm, the running direction of the fiber bundle Tm and the rotating direction of the contact member 42 are the same direction, but even if the rotating direction of the contact member 42 is opposite to the running direction of the fiber bundle Tm, the fiber bundle Tm can be temporarily brought into the relaxed state. If the contact member 42 is rotated in the direction opposite to the running direction of the fiber bundle Tm and is brought into contact, the contact member 42 is moved in the direction inclined with respect to the conveyance direction while in contact with the fiber bundle Tm and is rotated so as to push in and stroke the fiber bundle Tm.

The fiber bundle is usually formed by bundling a plurality of fibers and fixing them by a sizing agent or the like, and depending on a nature and an adhesion amount of the sizing agent or the like, the fibers can become difficult to be loosened. There is a method of heating the fiber bundle in order to weaken the fixing force of the sizing agent or the like, but if the contact member is pushed in so as to stroke the fiber bundle in contact as described above, each fiber in the fiber bundle is forcedly moved, and the fixing force can be weakened. Particularly, by rotating the contact member in the direction opposite to the running direction of the fiber bundle in contact as if stroking it, the contact resistance against the fiber becomes larger and the action for weakening the fixing force becomes larger, whereby the fiber bundle becomes easier to be loosened. However, if the contact member is rotated in the direction opposite to the running direction of the fiber bundle in contact, the fiber may be broken or become fluffy, and therefore it is important to adjust the rotation speed of the contact member to such a degree that the fibers are not affected as above.

Moreover, the shape of the contact member 42 may be any shape as long as the contact surface 42*a* can move while pushing in as if stroking the fiber bundle Tm and is not particularly limited. FIGS. 4A to 4D are sectional views relating to variations of the contact member 42. In FIG. 4A, the contact surface 42*a* is formed only on one side, and one session of the fluctuating operation can be performed while the contact member 42 rotates once. In FIG. 4B, protruding portions are formed in three directions from the center of the contact member 42, and the three contact surfaces 42*a* are disposed at equal intervals at tip end portions of the respective protruding portions, and three sessions of the fluctuating operation can be performed while the contact member 42 rotates once. In FIG. 4C, the protruding portions are formed in four directions from the center of the contact member 42, and the four contact surfaces 42*a* are disposed at equal intervals at tip end portions of the respective protruding portions, and four sessions of the fluctuating operation can be performed while the contact member 42 rotates once. In FIG. 4D, the contact surfaces 42*a* on both side ends are formed each having a swollen shape in an arc state, and a surface area of the contact surface 42*a* is larger. In this case, similarly to the contact member 42 illustrated in FIGS. 1A and 1B, two sessions of the fluctuating operation can be performed while the contact member 42 rotates once. By forming one or more contact surfaces on the contact member as above and by rotating the support shaft on which the contact member is mounted, the contact surface pushes in the fiber bundle. The portion of the contact surface 42*a* of the contact member 42 may be constituted by a movable portion with less friction resistance such as a rotating roller.

The contact surfaces formed on the contact member may be disposed at an irregular interval instead of arrangement at an equal interval as in the aforementioned example. If an interval between the contact surfaces is set longer, time during which the contact surface is separated becomes longer, the tension applied to the fiber bundle in the fiber-opening processing portion lowers, and the fiber-opening efficiency lowers. On the other hand, if the interval between the contact surfaces is set shorter, the contact time becomes longer, the stress state of the fiber bundle becomes longer, and a separation action of the sizing agent for fixing the fibers of the fiber bundle to each other becomes larger, which improves uniform distribution performances of the fibers. Therefore, making the intervals of the contact surfaces of the contact member different makes it possible to optimize both the fiber-opening efficiency and the uniform distribution performances while improving both of them. Moreover, even when the contact surfaces are disposed at an equal interval, adjusting the rotation speed of the contact member makes it possible to control timing when the contact surface is brought into contact with the fiber bundle, and an effect similar to that in the case of the arrangement at an irregular interval can be obtained.

In the aforementioned example, the sectional shape of the contact surface 42*a* is formed into an arc shape, but it may be formed into a curved shape other than the arc shape and is not particularly limited. For example, the sectional shape may be any shape such as an elliptic shape, as long as it can reduce damage given to the fiber bundle Tm when the contact surface 42*a* is brought into close contact with the fiber bundle Tm and strokes it. The contact surface 42*a* is preferably subjected to emboss-plating processing, for example, so as not to give damage to the fiber. Moreover, in the section in the longitudinal direction of the contact member 42, the contact surface 42*a* is linear, but it may be any shape other than the straight line as long as it is a shape that can be brought into contact with the fiber bundle Tm. For example, it may be formed into a curved shape swollen outward.

Moreover, in the aforementioned example, a moving operation of the contact surface 42*a* of the contact member 42 with respect to the fiber bundle Tm is a rotating operation by rotation/driving of the driving motor, but it is only necessary that the contact member is moved in the direction inclined at least with respect to the conveyance direction while in contact with the fiber bundle Tm so that the fiber bundle Tm is pushed in, and the operation is not limited to the rotating operation. For example, the contact member 42 may be reciprocated so as to swing in the conveyance direction of the fiber bundle Tm and push in the fiber bundle Tm to be brought into contact with and be separated away from that. Moreover, even if the contact member 42 moves linearly, if the linear direction is a direction inclined with respect to the conveyance direction, the linear movement includes movement in a direction orthogonal to the conveyance direction in which the fiber bundle Tm is pushed in and movement in the conveyance direction of moving in contact with the fiber bundle Tm, and working effects similar to those of the aforementioned rotating operation can be exerted. If the contact member 42 is moved in contact with the fiber bundle Tm, it is only necessary that the contact member 42 and the fiber bundle Tm are relatively moved in contact with each other.

Figure 5A:
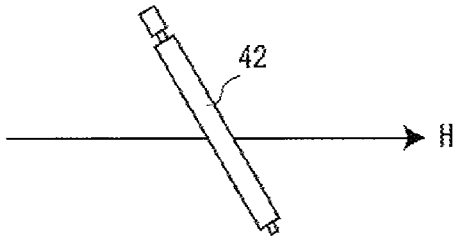
FIGS. 5A and 5B are explanatory views relating to arrangement of the contact member.
Figure 5B:
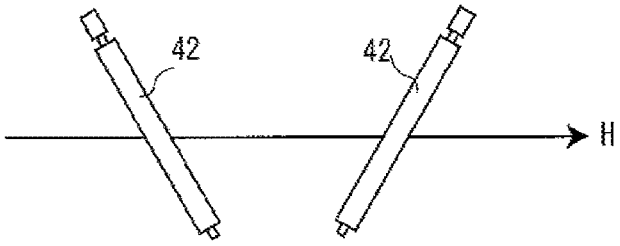

Moreover, by disposing the contact member 42 in a diagonal direction so as to cross a conveyance direction H of the fiber bundle Tm as illustrated in FIGS. 5A and 5B, the rotating direction of the contact surface 42*a* becomes the diagonal direction with respect to the fiber bundle Tm. Thus, it acts so as to expand the fiber bundle Tm in the width direction and to promote the fiber-opening processing. In FIG. 5A, the one contact member 42 is set in the diagonal direction so as to act to expand the fiber bundle Tm to one side in the width direction, but as illustrated in FIG. 5B, by setting the two contact members 42 in directions different from each other, they act to expand the fiber bundle Tm to both sides in the width direction.

As described above, the fluctuation imparting portion 4 includes setting means for setting a fluctuation imparting region such as the guide roll 41, the contact member on which the contact surface in contact with the fiber bundle Tm is formed, and driving means for moving the contact member such as the driving motor 43 and performs the fluctuating operation of moving the contact member in the direction inclined at least with respect to the conveyance direction while in contact with the conveyed fiber bundle Tm to push a part of the fiber bundle Tm into the stress state, and then separating the contact member from the fiber bundle Tm so as to temporarily bring the fiber bundle Tm in the relaxed state.

The fiber bundle Tm is formed into a fiber sheet Ts having a small thickness in which the fibers are opened by the fiber-opening processing portion 3 and the fluctuation imparting portion 4 and they are uniformly distributed. The fiber sheet Ts is sandwiched and conveyed by a take-up roll 51 of the conveying portion 5. The take-up roll 51 is rotated and driven by a take-up motor 52 and takes in and conveys the fiber sheet Ts. Thus, the conveyance speed of the fiber bundle Tm can be adjusted by the rotation speed of the take-up motor 52. The fiber sheet Ts conveyed out by the take-up roll 51 is taken up by a taking-up device, not shown, or conveyed into a resin impregnating device or the like as it is and worked into a prepreg sheet.

Figure 6A:
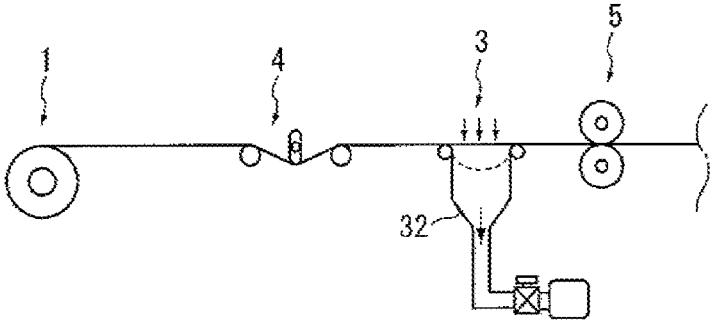
FIG. 6A is a schematic side view relating to a case in which arrangement of a fluctuation imparting portion is changed.
Figure 6B:
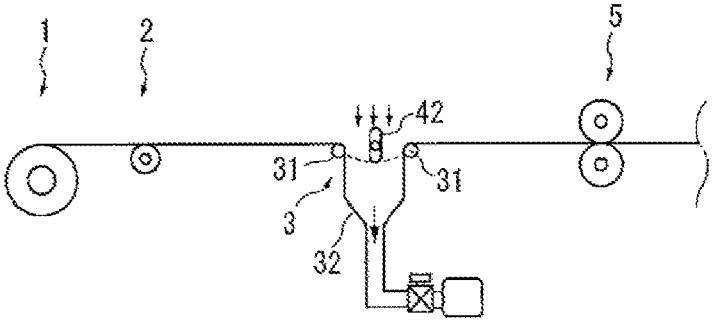
FIG. 6B is a schematic side view relating to a case in which the arrangement of the fluctuation imparting portion is changed.

In FIGS. 1A and 1B, the fluctuation imparting portion 4 is disposed in the conveying path of the fiber bundle Tm between the fiber-opening processing portion 3 and the conveying portion 5, but as illustrated in FIG. 6A, it may be disposed on an upstream side of the conveying path with respect to the fiber-opening processing portion 3. Alternatively, as illustrated in FIG. 6B, the contact member 42 may be disposed between the guide rolls 31 of the fiber-opening processing portion 3 so as to perform the fluctuating operation. In this case, the fluctuation imparting portion is disposed in the fiber-opening processing portion 3. In the example illustrated in FIG. 6B, when the contact member 42 pushes in the fiber bundle Tm, an interval between the contact member 42 and the guide roll 31 becomes wide and has a small influence on passage of the fluid, but at the moment when the contact member 42 is separated from the state in which the fiber bundle Tm has been pushed in, as illustrated in FIG. 3D, the interval between the contact surface 42*a* and the guide roll 31 becomes narrower, and the fluid passage region becomes smaller. Thus, a flow velocity of the fluid passing between the contact surface 42*a* and the guide roll 31 temporarily increases, and a force to expand the fiber of the fiber bundle Tm in the width direction becomes larger. As described above, by disposing the fluctuation imparting portion in the fiber-opening processing portion, it is possible to improve the fiber-opening action.

In the fiber-opening processing portion 3, the fiber bundle Tm is in the bent state by passage of the fluid, but since the conveyance direction is set in a direction in which the fiber bundle Tm is stretched between the pair of guide rolls 31, the contact member 42 moves in the direction inclined with respect to the conveyance direction while in contact with the fiber bundle Tm similarly to the example illustrated in FIGS. 1A and 1B. Since the fiber bundle Tm runs while being bent, at the moment when the contact surface 42*a* of the contact member 42 is brought into contact with the fiber bundle Tm, the contact surface 42*a* is brought into contact with the fiber bundle Tm substantially along the running direction thereof and moves in contact with the fiber bundle Tm and pushes in the fiber bundle Tm into the stress state, and it gives little damage while the contact member 42 is in contact with the fiber bundle Tm.

Figure 7:
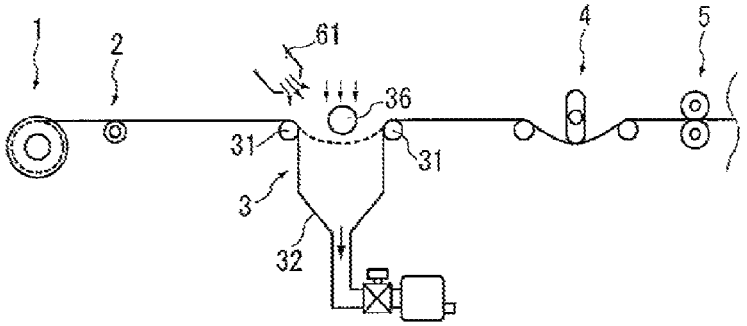
FIG. 7 is a schematic side view relating to the variation of the device for opening a fiber bundle illustrated in FIGS. 1A and 1B.

FIG. 7 is a schematic side view relating to a variation of the device for opening a fiber bundle. The same reference numerals are given to the same portions as those in the device example illustrated in FIGS. 1A and 1B, and the explanation for the portions will be omitted. In this device example, a bending roll 36 is provided in the upper opening portion of the wind tunnel pipe 32 of the fiber-opening processing portion 3. The fiber bundle Tm passing through the upper side of the guide rolls 31 is conveyed so as to pass through the lower side of the bending roll 36. The bending roll 36 is positioned below the guide rolls 31, and the fiber bundle Tm passing between the guide rolls 31 is set to a state curved at all times by the bending roll 36. Thus, the fiber bundle Tm does not become a linear shape in the fiber-opening processing by the fluctuating operation by the fluctuation imparting portion 4, and contraction of the fiber-opening width of the fiber bundle can be prevented.

Moreover, in this device example, a heating mechanism 61 which heats the fiber bundle Tm by blowing hot air in correspondence with the fiber-opening processing portion 3 is provided. By heating the fiber bundle Tm to be opened, the sizing agent adhering to the fiber bundle Tm can be softened. Thus, the fibers can be easily untangled, and the fibers are uniformly distributed in the fiber-opening processing.

Figure 8:
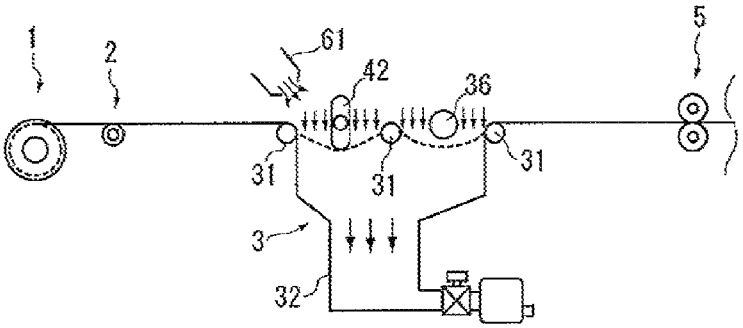
FIG. 8 is a schematic side view relating to another variation of the device for opening a fiber bundle illustrated in FIGS. 1A and 1B.

FIG. 8 is a schematic side view relating to another variation of the device for opening a fiber bundle. The same reference numerals are given to the same portions as those in the device example illustrated in FIGS. 1A and 1B, and the explanation for the portions will be omitted. In this device example, three guide rolls 31 are provided in the fiber-opening processing portion 3, and the bending roll 36 and the contact member 42 are provided between the guide rolls 31, respectively. Therefore, in the fiber-opening processing portion 3, the fiber bundle Tm is formed in the state bent twice and fiber opening is performed and at the same time, the fluctuating operation by the rotation of the contact member 42 is performed, whereby the fiber-opening is performed efficiently.

Figure 9A:
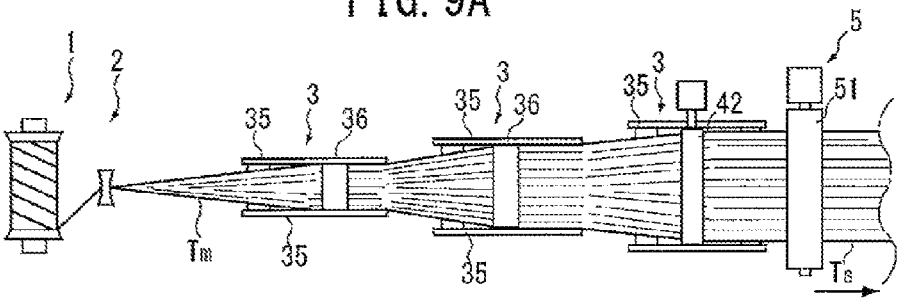
FIG. 9A is a schematic plan view relating to still another variation of the device for opening a fiber bundle illustrated in FIGS. 1A and 1B.
Figure 9B:
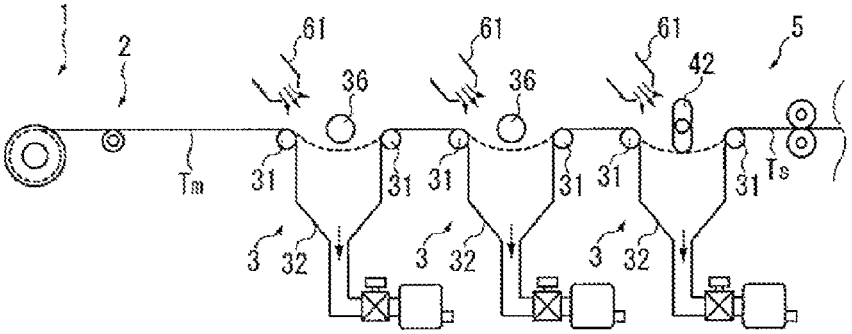
FIG. 9B is a schematic side view relating to still another variation of the device for opening a fiber bundle illustrated in FIGS. 1A and 1B.

FIGS. 9A and 9B are a schematic plan view (FIG. 9A) and a schematic side view (FIG. 9B) relating to still another variation of the device for opening a fiber bundle. In this device example, the fiber-opening processing portions 3 are disposed at three spots along the conveying path of the fiber bundle Tm. The heating mechanisms 61 are provided in correspondence with the fiber-opening processing portions 3, respectively. In each of the fiber-opening processing portions 3 at two spots on the upstream side, the bending roll 36 is disposed between the guide rolls 31, and the contact member 42 is disposed between the guide rolls 31 in the fiber-opening processing portion 3 on the downstream side. In this example, the adjacent fiber-opening processing portions 3 are disposed at predetermined intervals, but the fiber-opening processing portions 3 can be continuously disposed by substituting the one guide roll 31 for the two adjacent guide rolls 31.

A pair of guide members 35 are mounted along the conveyance direction on the both sides of the upper opening portion of the wind tunnel pipe 32 so that the fiber-opening width is defined by the guide members 35 when fiber opening is performed by passage of the suction airflow through the fiber bundle Tm being conveyed between the guide rolls 31.

As the guide members 35, the upper opening portions of the wind tunnel pipe 32 may be formed into a rectangular shape so that the side walls of the opening portion can be used as they are. Alternatively, a plurality of wires or the like is provided upright in the wind tunnel pipe 32 to be used as the guide members.

The fiber-opening width defined by the guide members 35 of each of the fiber-opening processing portions 3 is set such that the width sequentially becomes larger as it goes from the upstream side toward the downstream side. By setting the fiber-opening width as above, the fiber bundle Tm can be gradually opened and expanded, and the fiber-opening processing which is wide and has fibers uniformly distributed can be performed without difficulty. Particularly, when the fiber bundle with large fineness is to be subjected to the fiber-opening processing, by installing the fiber-opening processing portions at a plurality of spots so as to gradually expand the fiber-opening width, the wide fiber-opening processing with excellent fiber distribution performances can be executed.

Figure 10A:
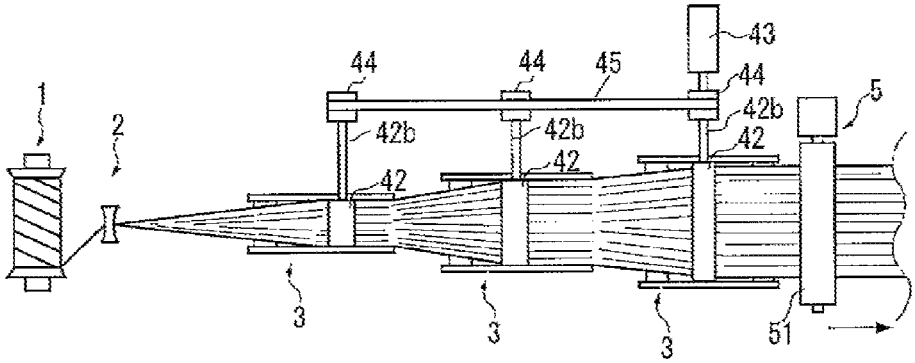
FIG. 10A is a schematic plan view relating to still another variation of the device for opening a fiber bundle illustrated in FIGS. 1A and 1B.
Figure 10B:
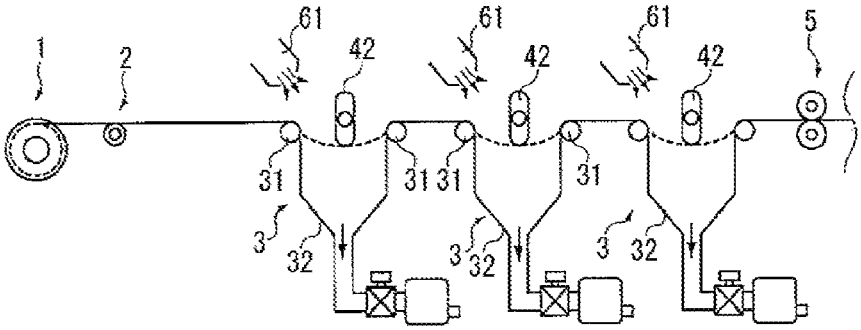
FIG. 10B is a schematic side view relating to still another variation of the device for opening a fiber bundle illustrated in FIGS. 1A and 1B.

FIGS. 10A and 10B are a schematic plan view (FIG. 10A) and a schematic side view (FIG. 10B) relating to still another variation of the device for opening a fiber bundle. In this device example, the fiber-opening processing portions 3 are disposed at three spots along the conveying path of the fiber bundle Tm similarly to FIGS. 9A and 9B. The heating mechanisms are provided in correspondence with the fiber-opening processing portions 3, respectively, and the fiber-opening width of each fiber-opening processing portion 3 is set so as to sequentially become wider as it goes from the upstream side toward the downstream side. In each of the fiber-opening processing portions 3, the contact member 42 is disposed between the guide rolls 31. Since the contact member 42 is disposed in correspondence with each of the fiber-opening processing portions 3, a sufficient bent amount of the fiber bundle Tm is ensured in each of the fiber-opening processing portions 3.

A driving pulley 44 is fixed to each of the support shafts 42*b* of the contact member 42, and each of the driving pulleys 44 is connected to the driving motor 43 through a driving transmission belt 45. By rotating/driving the driving motor 43, each of the driving pulleys 44 is rotated, and the contact member 42 starts a rotating operation in synchronization with that. As described above, since the plurality of contact members can be rotated by the single driving motor, the device constitution can be simplified, and a device cost can be reduced.

In the aforementioned device example, the driving transmission belt is used, but a driving transmission chain may be also used. Moreover, the plurality of contact members is rotated in synchronization, but the rotation timing of the contact members can be made different from each other easily, and the fluctuating operation can be made at optimal timing by adjusting the rotation timing in accordance with characteristics of the fiber bundle such as a type, fineness, a number and the like and the fiber-opening width. For example, by pushing in the plurality of contact members in contact with the fiber bundle substantially at the same time, the sufficient bent amount of the fiber bundle can be ensured in each of the fiber-opening processing portions, but tension fluctuation of the fiber bundle becomes larger and results in fiber breakage or the like in some cases. In such a case, by shifting the rotation timing of the contact members, it can be set such that the bent amount of the fiber bundle can be ensured while the tension fluctuation of the fiber bundle is suppressed.

Figure 11A:
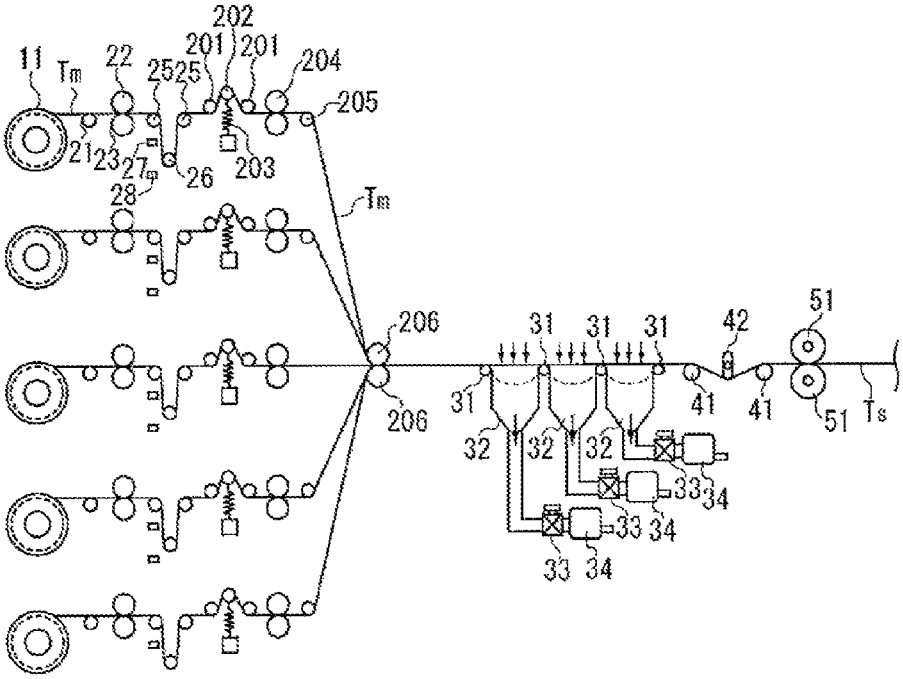
FIG. 11A is a schematic side view relating to another embodiment of the device for opening a fiber bundle according to the present invention.
Figure 11B:
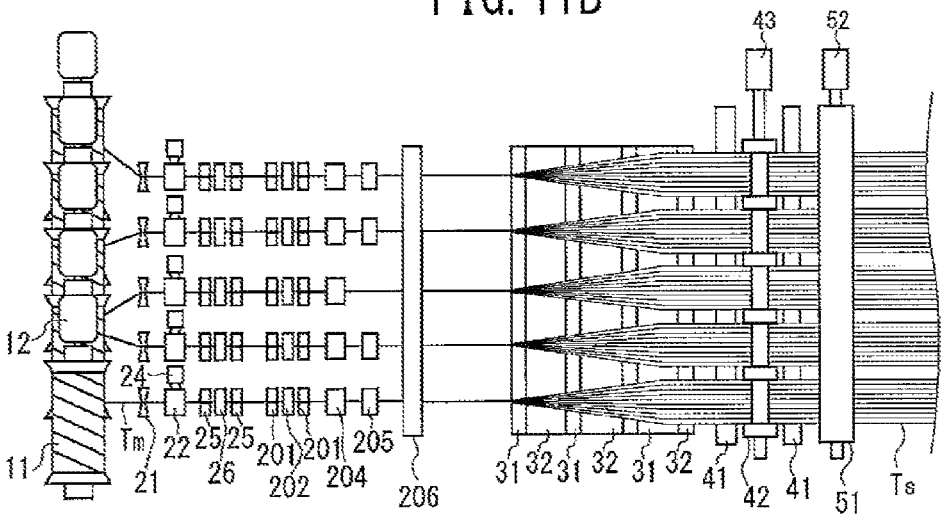
FIG. 11B is a schematic plan view relating to another embodiment of the device for opening a fiber bundle according to the present invention.

FIGS. 11A and 11B are a schematic side view (FIG. 11A) and a schematic plan view (FIG. 11B) of another embodiment of the device for opening a fiber bundle according to the present invention. In this device example, a plurality of the fiber sheets Is can be formed at the same time by opening a plurality of the fiber bundles Tm in parallel.

In this example, a yarn feeding motor 12 is mounted on the yarn feeding body 11, and by rotating/driving the yarn feeding motor 12, a fed-out amount from the yarn feeding body 11 can be adjusted. The fiber bundle Tm fed out of the yarn feeding body 11 is pulled out toward a predetermined pulling-out direction by the guide roll 21 rotatably supported at a predetermined position. The pulled-out fiber bundle Tm is sandwiched by a feeding roll 22 and a support roll 23 and fed/supplied in a predetermined feeding amount. The feeding amount of the fiber bundle Tm is adjusted by controlling the rotating operation of the feeding/supply motor 24 for rotating the feeding roll 22.

The fiber bundle Tm fed/supplied by the feeding roll 22 is supported by a pair of support rolls 25 arrayed at a predetermined interval in the conveyance direction of the fiber bundle Tm and conveyed. Between the support rolls 25, a tension stabilizing roll 26 is provided capable of being elevated up/down, and the fiber bundle Tm is set so as to go round to the lower sides of the tension stabilizing roll 26 from the upper sides of the support rolls 25. Then, if the length of the fiber bundle Tm passing between the support rolls 25 changes, the tension stabilizing roll 26 is elevated up/down in accordance with that. The elevating operation of the tension stabilizing roll 26 is detected by an upper-limit position detection sensor 27 and a lower-limit position detection sensor 28.

When the tension stabilizing roll 26 rises and the upper-limit position detection sensor 27 detects the tension stabilizing roll 26, the feeding amount of the fiber bundle Tm is increased, while if the tension stabilizing roll 26 lowers and the lower-limit position detection sensor 28 detects the tension stabilizing roll 26, the feeding amount of the fiber bundle Tm is decreased.

As described above, the feeding amount of the fiber bundle Tm is adjusted so that the tension stabilizing roll 26 is located within a predetermined range on the basis of the detection signals from the upper-limit position detection sensor 27 and the lower-limit position detection sensor 28 so that the tension of the fiber bundle Tm is made stable by the weight of the tension stabilizing roll 26 itself.

On the downstream side of the tension stabilizing roll 26, as a mechanism for reducing vibration of the fiber bundle Tm, a pair of support rolls 201 and a tension roll 202 are provided. The tension roll 202 is arrayed between the pair of support rolls 201 and set so that the fiber bundle Tm passing through the lower sides of the support rolls 201 passes through the upper side of the tension roll 202. And an urging member 203 is provided for urging the tension rolls 202 so that they move upward, and the tension roll 202 is urged upward. With the constitution as above, the vibration of the fiber bundle Tm generated by the fluctuation imparting portion is reduced.

On the downstream side of the support rolls 201, nip rolls 204 are provided, and the fiber bundle Tm is sandwiched by the nip rolls 204 and conveyed to the fiber-opening portion. In the nip roll 204, a one-way clutch, not shown, is mounted and allows rotation only in a direction for feeding out the fiber bundle Tm and prevents rotation in a direction for pulling back.

The fiber bundle Tm fed out of each yarn feeding body 11 is given a predetermined tension and is fed out by passing through the nip rolls 204, respectively, and is conveyed by a guide roll 205 toward aligning rolls 206. The aligning rolls 206 align the plurality of conveyed fiber bundles Tm so as to be arrayed at an equal interval on the same plane and convey out the plurality of fiber bundles Tm.

The fiber bundle Tm set to a tension in the predetermined range passes through the plurality of fiber-opening processing portions arrayed in the conveyance direction. Each of the fiber-opening processing portions supports the fiber bundle Tm by a pair of the guide rolls 31 arrayed in the conveyance direction. The wind tunnel pipe 32 is provided between the guide rolls 31, and the upper opening portion of the wind tunnel pipe 32 is formed having a predetermined width between the guide rolls 31. On the lower side of the wind tunnel pipe 32, the flow control valve 33 and the air intake pump 34 are mounted, and by operating the air intake pump 34 and by suctioning the air in the wind tunnel pipe 32, a downward air flow is generated by suctioning at the upper opening portion between the guide rolls 31.

If the suctioned airflow passes through the fiber bundle Tm being conveyed between the guide rolls 31, the fiber bundle Tm is brought into a bent state by a flow velocity of the air flow. When the air flow passes through the space among the fibers of the fiber bundle Tm in the bent state, a force to move the fibers in the width direction of the fiber bundle Tm acts, and the fiber bundle Tm is opened. Such an opening action is known.

On the downstream side of the fiber-opening processing portion, the fluctuation imparting portion is disposed. In the fluctuation imparting portion, the plurality of fiber bundles Tm having been opened by the pair of guide rolls 41 arrayed in the conveyance direction is supported for the whole widths thereof. Between the guide rolls 41, the contact member 42 is disposed. The contact member 42 is disposed on a side opposite to the guide rolls 41 with respect to the conveyed fiber bundle Tm and set to the length capable of being in contact with the whole width of the plurality of spread fiber bundles Tm. The contact member 42 is formed having a shape similar to the contact member described in FIGS. 1A and 1B and includes a pair of contact surfaces on both side ends. Then, the contact member is rotated by the rotation/driving of the driving motor 43, and the pair of contact surfaces of the contact member 42 move in the direction inclined with respect to the conveyance direction alternately in contact with the fiber bundles Tm and rotate as if stroking the surface of the fiber bundles Tm and pushes the fiber bundles Tm between the guide rolls 41 into the stress state. When the contact surfaces further rotate upward and at the moment when the contact surfaces are separated from the fiber bundles Tm in the stress state, the fiber bundles Tm temporarily enter the relaxed state. At that time, the fiber bundles Tm in the fiber-opening processing portion are brought into the state largely bent in the passage direction of the fluid, and efficiency of the fiber-opening processing can be improved.

The fiber bundles Tm are repeatedly subjected to the fluctuating operation by the fluctuation imparting portion and opened by the fiber-opening processing portion several times and formed into a fiber sheet Ts having a small thickness in which the fibers are uniformly distributed. The fiber sheet Ts is sandwiched by the take-up rolls 51 and conveyed. The take-up roll 51 is rotated/driven by the take-up motor 52 and pulls in the fiber sheet Is and conveys the fiber sheet Ts. The fiber sheet Ts conveyed out by the take-up roll 51 is taken up by the taking-up device, not shown, or conveyed into the resin impregnating device or the like as it is and worked into a prepreg sheet.

Figure 12:
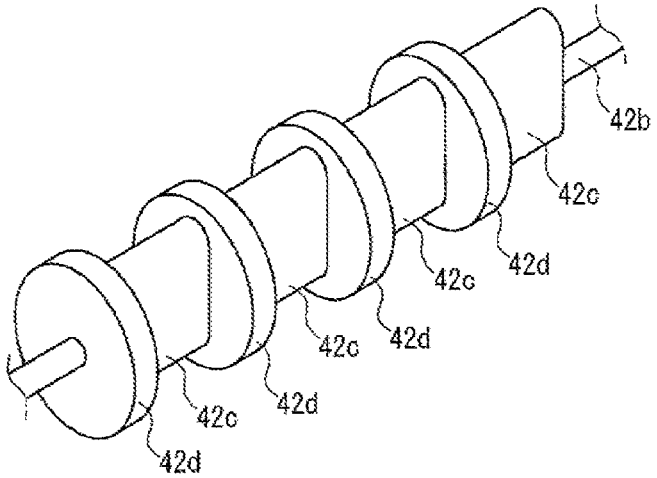
FIG. 12 is a perspective view relating to the contact member.
Figure 13:
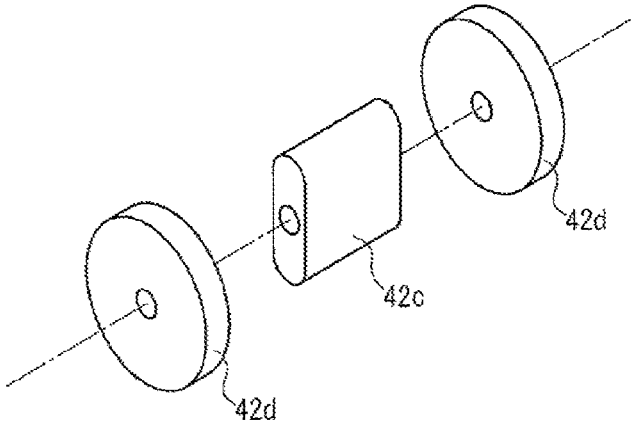
FIG. 13 is an exploded perspective view relating to a part of the contact member.

FIG. 12 is a perspective view relating to the contact member 42. The contact member 42 includes a contact portion 42*c* moving the fiber bundle Tm in the direction inclined with respect to the conveyance direction and pushing it in contact and a width regulating portion 42*d* for setting the opened fiber bundle Tm to a predetermined width. FIG. 13 is an exploded perspective view relating to a part of the contact member 42. The contact portion 42*c* is formed having a shape similar to the contact member described in FIGS. 1A and 1B, and a pair of contact surfaces are formed on both side ends. The width regulating portions 42*d* are formed each having a disc shape with a predetermined thickness and are disposed so as to abut against the both sides of the contact portion 42*c* in a direction along the support shaft 42*b*.

When the contact member 42 is rotated around the support shaft 42*b*, the fiber bundle Tm is conveyed by having the both sides regulated by the width regulating portions 42*d* and is repeatedly subjected to the fluctuating operation by the contact portion 42*c* during the conveyance.

Figure 14A:
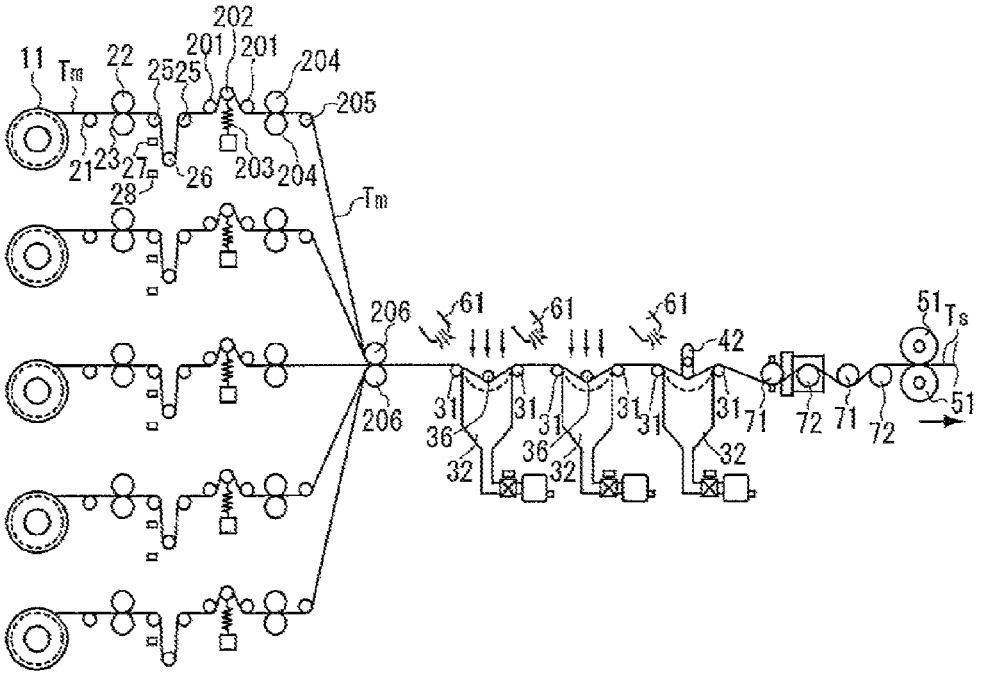
FIG. 14A is a schematic side view relating to still another embodiment of the device for opening a fiber bundle according to the present invention.
Figure 14B:
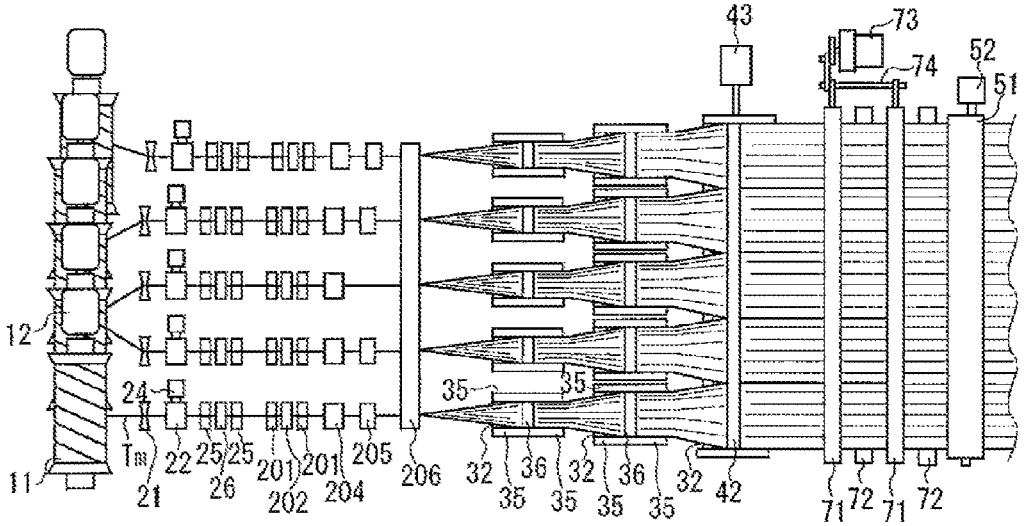
FIG. 14B is a schematic plan view relating to still another embodiment of the device for opening a fiber bundle according to the present invention.

FIGS. 14A and 14B are a schematic side view (FIG. 14A) and a schematic plan view (FIG. 14B) relating to another embodiment of the device for opening a fiber bundle according to the present invention. The same reference numerals are given to the same portions as those in the device example illustrated in FIGS. 11A and 11B, and the explanation for the portions will be omitted.

In this device example, the plurality of conveyed fiber bundles Tm is opened in the three fiber-opening processing portions similarly to the device example illustrated in FIGS. 11A and 11B, but the fiber-opening processing portion on the most downstream side has the upper opening portion formed over the whole width so that the plurality of the fiber bundles Tm is opened altogether. Moreover, in the two fiber-opening processing portions on the upstream side, the bending roll 36 is disposed between the guide rolls 31, and in the fiber-opening processing portion on the most downstream side, the contact member 42 is disposed between the guide rolls 31.

In the two fiber-opening processing portions on the upstream side, a pair of the guide members 35 are mounted on the both sides of the upper opening portion of the wind tunnel pipe 32 along the conveyance direction, and as described in FIG. 9, the fiber-opening width defined by the guide members 35 of the two fiber-opening processing portions is set so as to gradually become wider as it goes from the upstream side toward the downstream side. By setting the fiber-opening width as above, the fiber bundles Tm can be sequentially opened and expanded, and the fiber-opening processing which is wide and has the fibers uniformly distributed can be performed without difficulty.

The fiber bundles to which the fiber-opening processing as above is applied are subjected to the fluctuating operation by the contact member 42 altogether in the fiber-opening processing portion on the most downstream side. The heating mechanism 61 in correspondence with each of the fiber-opening processing portions so that the fiber bundles subjected to the fiber-opening processing are heated and the fibers are untangled easily.

On the downstream side of the fiber-opening processing portion, a width-direction fluctuation imparting portion in sliding contact with the fibers of the fiber sheet Ts in the width direction is provided. The width-direction fluctuation imparting portion has a pair of bow bars 71 arrayed over the whole width on the upper side of the fiber sheet Ts, and a support roll 72 is arrayed on the lower side of the fiber sheet Ts. The bow bars 71 are connected to a crank mechanism 74, and by driving the crank mechanism 74 by a crank motor 73, the bow bars 71 are moved forward/backward in the width direction of the fiber sheet Ts. By forward/backward movement of the bow bars 71 and the sliding contact with the fibers in the fiber sheet Ts, a portion where the fibers adhere to each other can be gently untangled, and the entire fiber sheet Is can be finished into a single sheet state in which the fibers are uniformly distributed.

The fiber sheet Ts subjected to the fluctuation processing in the width direction is sandwiched by the take-up rolls 51 and conveyed. The take-up rolls 51 are rotated/driven by the take-up motor 52 and pull in the fiber sheet Ts and convey the fiber sheet Ts. The fiber sheet Ts conveyed out by the take-up rolls 51 is taken up by the taking-up device, not shown, or conveyed into a resin impregnating device or the like as it is and worked into a prepreg sheet.

Figure 15A:
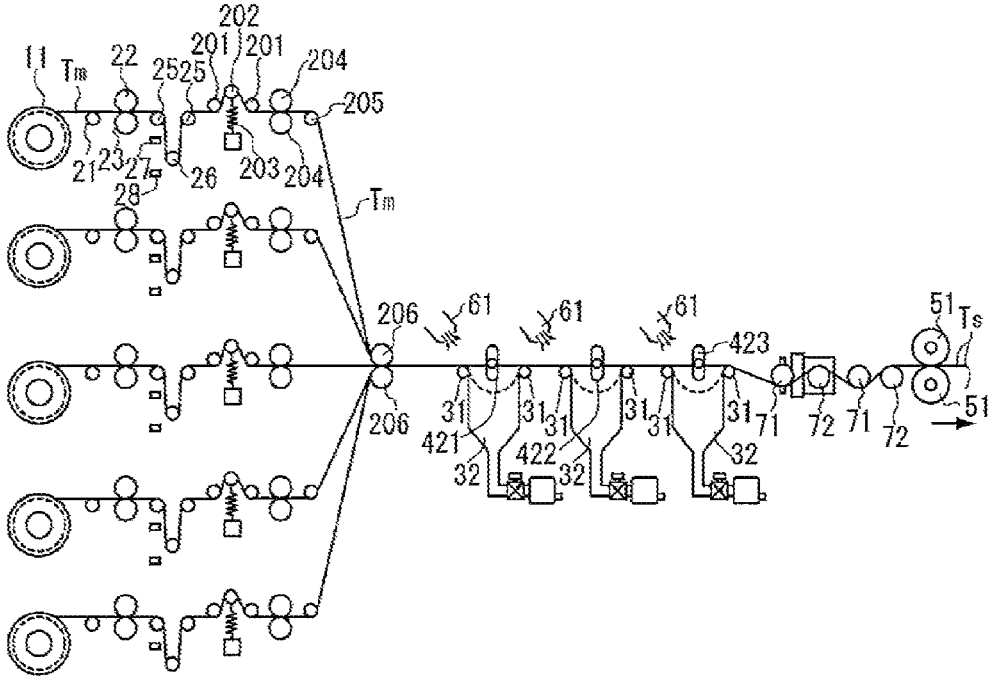
FIG. 15A is a schematic side view relating to a variation of the device for opening a fiber bundle illustrated in FIG. 14.
Figure 15B:
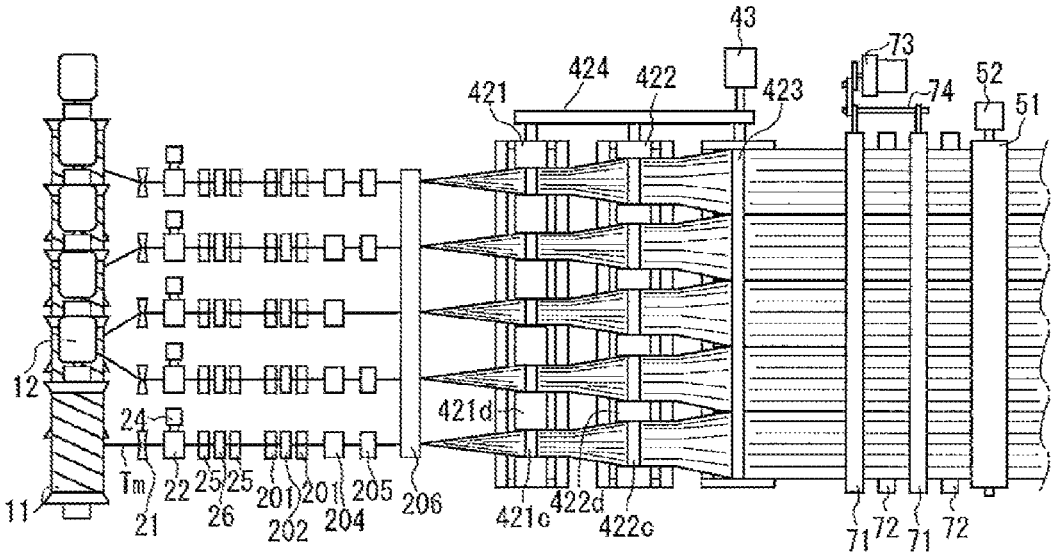
FIG. 15B is a schematic plan view relating to a variation of the device for opening a fiber bundle illustrated in FIG. 14.

FIGS. 15A and 15B are a schematic side view (FIG. 15A) and a schematic plan view (FIG. 15B) relating to a variation of the device for opening a fiber bundle illustrated in FIGS. 14A and 14B. The same reference numerals are given to the same portions as those in the device example illustrated in FIGS. 14A and 14B, and the explanation for the portions will be omitted.

In this device example, in the three fiber-opening processing portions, contact members 421, 422, and 423 are disposed between the guide rolls 31, respectively. Each of the contact members is connected to the driving motor 43 through a driving transmission belt 424 similarly to the device example illustrated in FIGS. 10A and 10B and is rotated in synchronization by rotation/driving of the driving motor 43.

The contact member 421 disposed in the fiber-opening processing portion on the most upstream side has a wide width regulating portion 421*d* disposed between the contact portions 421*c*, and the contact member 422 disposed in the subsequent fiber-opening processing portion has a narrow width regulating portion 422*d* disposed between the contact portions 422*c*. Thus, the fiber-opening width of the fiber bundle Tm is set so as to sequentially become wider as it goes from the upstream side toward the downstream side similarly to the device example illustrated in FIGS. 14A and 14B.

By applying the fluctuation by the contact member in each of the fiber-opening processing portions, the fiber-opening processing can be efficiently performed. Moreover, in the fiber-opening processing portion on the most downstream side, after the fluctuating operation by the contact member is received altogether, the fluctuating operation by the width-direction fluctuation imparting portion is received, and the fiber sheet Ts integrated in the width direction can be finished.

EXAMPLE

Example 1

The contact member was disposed in the fiber-opening processing portion as illustrated in FIGS. 6A and 6B, and the device constitution with the heating mechanism illustrated in FIG. 7 provided was used. As the fiber bundle, a carbon fiber bundle (by Mitsubishi Rayon Co., Ltd. Pyrofil TR50S-15K; fiber diameter approximately 7 μm, number of bundled fibers 15000) was used. An original width of the fiber bundle was approximately 6 mm.

Figure 16A:
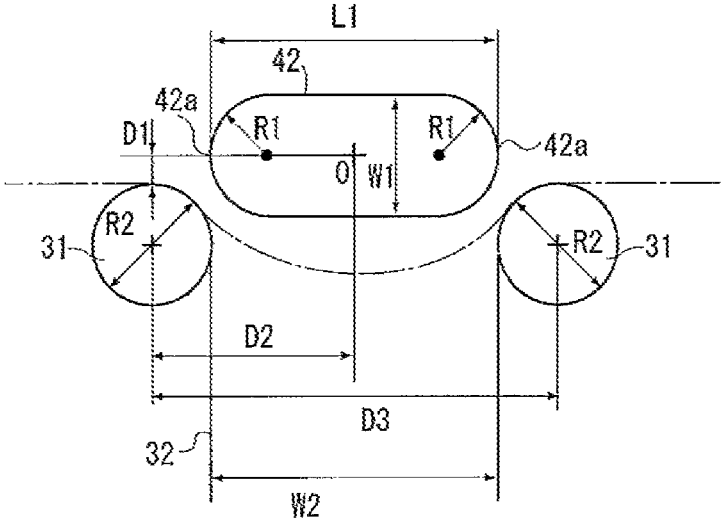
FIG. 16A is an explanatory view relating to dimensional setting of a fiber-opening processing portion of an example.
Figure 16B:
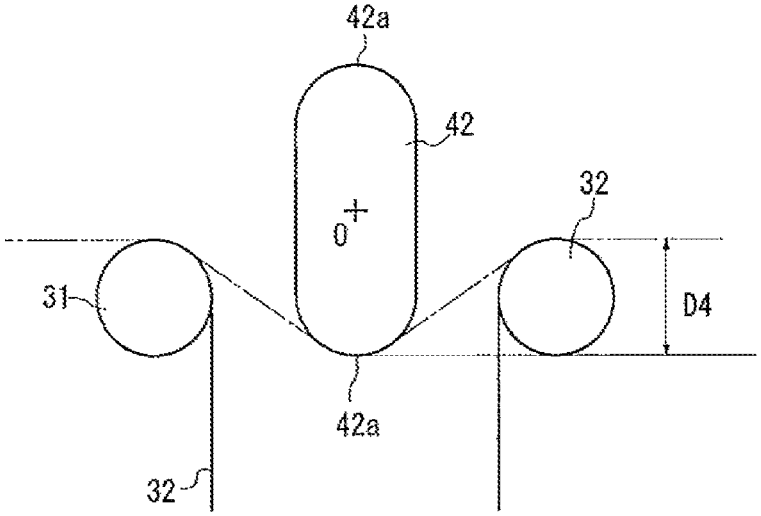
FIG. 16B is an explanatory view relating to dimensional setting of the fiber-opening processing portion of an example.

Regarding the device constitution in the fiber-opening processing portion, dimensions illustrated in FIGS. 16A and 16B were set as follows:

Contact member 42; length L1=30 mm, width W1=12 mm

Contact surface 42*a*; radius of curvature R1 of sectional shape=6 mm

Guide roll 31; outer diameter R2=12 mm

Wind tunnel pipe 32; length W2 in conveyance direction=30 mm

Height difference D1 between center axis O of contact member 42 and top point of guide roll 31=3 mm Interval D2 between center axis O of contact member 42 and center shaft of guide roll 31=21 mm Interval D3 between center shafts of guide rolls 31=42

Height difference D4 between lowest point during rotation of contact surface 42*a* and top point of guide roll 31=12 mm A heating temperature of the heating mechanism was set to 100° C., and the flow velocity of the suctioned air flow of the wind tunnel pipe 32 was set to 20 m/second in a state with no fiber bundle. The fiber-opening width of the wind tunnel pipe 32 was set to 24 mm. The initial tension of the fiber bundle was set to 150 g and was conveyed at the conveyance speed of 30 m/minute. The rotation speed of the contact member was set to 800 rpm, and the fluctuating operation was performed 1600 times per minute. In this case, the passage time of the fiber bundle through the wind tunnel pipe 32 was 30 mm/30 m=0.001 minutes, and by setting the number of fluctuating operation times to 1000 times/minute or more, the entire fiber bundle can be opened/processed uniformly.

Here, the width and the thickness of the opened fiber bundle are measured in a natural state in which no force is applied to the opened fiber bundle. The fiber-opening width is measured by using a length meter capable of measuring to 1 mm at the minimum, and the thickness is measured by an external micrometer with a minimum display amount of 0.001 mm specified in JIS B 7502 (complying with the international standard ISO 3611).

Regarding the measurement of the width and the thickness of the opened yarn sheet, a plurality of spots is measured in order to confirm continuous stability of opening, and measurement is made at 10 spots at every 1 m in this example. Regarding the thickness, a spot to be measured from one end to the other end in the width direction is measured by the external micrometer, and fluctuation in the thickness in the width direction is measured. For example, by using a value a (value rounded up to one decimal place if it is indivisible) obtained by dividing the opened yarn sheet width by a measurement surface diameter of the external micrometer, a measurement position is set at an interval obtained by uniformly dividing a spot to be measured from one end to the other end in the width direction by the value a, and the thickness is measured.

As the result of the fiber-opening processing by setting as above, the fiber bundle could be finished to the uniformly distributed fiber sheet. In order to confirm continuity of the fiber-opening, the fiber-opening width and thickness were measured at 10 spots at every 1 m. The fiber-opening width was within a range of 22 to 24 mm, and the average fiber-opening width was approximately 23.5 mm. There was fluctuation of −6.4% to 2.1% to the average fiber-opening width. The thickness was in a range of 0.032 to 0.040 mm and the average thickness was 0.035 mm. There was fluctuation of −0.003 to 0.005 mm to the average thickness.

Example 2

In the device for opening a fiber bundle illustrated in FIGS. 9A and 9B, the wind tunnel pipe 32 and the bending roll 36 on the most upstream side were removed, and a device provided with a first fiber-opening processing portion having the wind tunnel pipe 32 and the bending roll 36 on the upstream side and a second fiber-opening processing portion having the wind tunnel pipe 32 and the contact member 42 on the downstream side was used. Similarly to Example 1, the carbon fiber bundle was used, and the first fiber-opening processing portion used the wind tunnel pipe similar to the Example 1, the fiber-opening width was set to 24 mm, and the bending roll (outer diameter of 12 mm) was disposed at a center in the conveyance direction (at the center of the length of the wind tunnel pipe in the conveyance direction and at a position at the same height as the guide roll 31). The second fiber-opening processing portion used what is similar to the Example 1, and the fiber-opening width was set to 48 mm. An interval between the first fiber-opening processing portion and the second fiber-opening processing portion was set to 30 mm.

The heating temperature, the flow velocity of the air flow in the wind tunnel pipe, the initial tension and the conveyance speed of the fiber bundle, and the rotation speed of the contact member were set to the same values as those in the Example 1, and the fiber-opening processing was executed.

As the result of the fiber-opening processing by setting as above, the fiber bundle could be finished to the uniformly distributed fiber sheet. In order to confirm continuity of the fiber-opening, the fiber-opening width and thickness were measured at 10 spots at every 1 m. The fiber-opening width was within a range of 44 to 48 mm, and the average fiber-opening width was approximately 46.5 mm. There was fluctuation of −5.4% to 3.2% to the average fiber-opening width. The thickness was in a range of 0.020 to 0.028 mm and the average thickness was 0.023 mm. There was fluctuation of −0.003 to 0.005 mm to the average thickness.

Example 3

In the device for opening a fiber bundle illustrated in FIGS. 10A and 10B, the first fiber-opening processing portion, the second fiber-opening processing portion, and the third fiber-opening processing portion were provided from the upstream side, and a device similar to that in the Example 1 was used for each of the fiber-opening processing portions. The fiber-opening width was set to 40 mm width for the first fiber-opening processing portion, to 60 mm width for the second fiber-opening processing portion, and to 80 mm width for the third fiber-opening processing portion. An interval between each of the fiber-opening processing portions was set to 50 mm. As the fiber bundle, the carbon fiber bundle (by SGL Co., Ltd., fiber diameter approximately 7 μm, number of bundled fibers 50000) was used. An original width of the fiber bundle was approximately 15 mm.

The heating temperature, the flow velocity of the air flow in the wind tunnel pipe, and the initial tension of the fiber bundle were set to the same values as those in the example, the conveyance speed to 20 m/minute, and the rotation speed of the contact member to 700 rpm, and the fluctuating operation was performed 1400 times per minute. In this case, the passage time of the fiber bundle through the wind tunnel pipe was 30 mm/20 m=0.0015 minutes, and by setting the number of fluctuating operation times to 667 times/minute or more, the entire fiber bundle can be opened/processed uniformly. The contact members installed in the first to third fiber-opening processing portions rotated in synchronization.

As the result of the fiber-opening processing by setting as above, the fiber bundle could be finished to the uniformly distributed fiber sheet. In order to confirm continuity of the fiber-opening, the fiber-opening width and thickness were measured at 10 spots at every 1 m. The fiber-opening width was within a range of 72 to 80 mm, and the average fiber-opening width was approximately 77.5 mm. There was fluctuation of −7.1% to 3.2% to the average fiber-opening width. The thickness was in a range of 0.031 to 0.043 mm and the average thickness was 0.038 mm. There was fluctuation of −0.007 to 0.005 mm to the average thickness.

Example 4

In the device for opening a fiber bundle illustrated in FIGS. 15A and 15B, two fiber-opening processing portions were disposed, that is, the first fiber-opening processing portion and the second fiber-opening processing portion were provided from the upstream side, and a device similar to that in the Example 1 was used for each of the fiber-opening processing portions. The fiber-opening width was set to 20 mm width for the contact member of the first fiber-opening processing portion and to 40 mm width for the contact member of the second fiber-opening processing portion, and the interval between the two fiber-opening processing portions was set to 50 mm. The rotating operation of the contact member of the second fiber-opening processing portion was set to be delayed only by 45 degrees of the rotation angle with respect to the rotating operation of the contact member of the first fiber-opening processing portion. For the contact member of the first fiber-opening processing portion, what has the structure illustrated in FIG. 12 was used, and the width of the contact portion 42*c* was set to 20 mm, and the width of the width regulating portion 42*d* to 20 mm. In the width-direction fluctuation imparting portion, the bow bar having the outer diameter of 25 mm was fluctuated/operated at a stroke of 5 mm and a number of vibration times of 500 rpm. As the fiber bundle, eight carbon fiber bundles (by Toray Industries, Inc.; Torayca T700SC-24K, fiber diameter approximately 7 μm, number of bundled fibers 24000) were used. An original width of the fiber bundle was approximately 12 mm.

The heating temperature, the flow velocity of the air flow in the wind tunnel pipe, and the initial tension of the fiber bundle were set to the same values as those in the Example 1, the conveyance speed of the first bundle to 20 m/minute, and the rotation speed of the contact member to 800 rpm, and the fluctuating operation was performed 1600 times per minute.

As the result of the fiber-opening processing by setting as above, the fiber bundle could be finished to the uniformly distributed fiber sheet having a width of 320 mm. In order to confirm continuity of the fiber-opening, one of the eight fiber sheets was taken out, and the fiber-opening width and thickness were measured at 10 spots at every 1 m. The fiber-opening width was within a range of 36 to 42 mm, and the average fiber-opening width was approximately 39.5 mm. There was fluctuation of −8.9% to 6.3% to the average fiber-opening width. The thickness was in a range of 0.032 to 0.040 mm and the average thickness was 0.037 mm. There was fluctuation of −0.005 to 0.003 mm to the average thickness.

REFERENCE SIGNS LIST

Tm fiber bundle
Ts fiber sheet
1 yarn feeding portion
2 guide portion
3 fiber-opening processing portion
4 fluctuation imparting portion
5 conveying portion
11 yarn feeding body
12 yarn feeding motor
22 feeding roll
23 support roll
24 feeding/supply motor
25 support roll
26 tension stabilizing roll
27 upper-limit position detection sensor
28 lower-limit position detection sensor
31 guide roll
32 wind tunnel pipe
33 flow control valve
34 air intake pump
35 guide member
36 bending roll
41 guide roll
42 contact member
43 driving motor
51 take-up roll
52 take-up motor
61 heating mechanism
71 bow bar
72 support roll
73 crank motor
74 crank mechanism
201 support roll
202 tension roll
203 urging member

204 nip roll
205 guide roll
206 aligning roll

The invention claimed is:

1. A method for opening a fiber bundle by pulling out the fiber bundle from a yarn feeding body and conveying the fiber bundle in a fiber length direction and by moving a fiber in a width direction while bending the fiber by letting a fluid pass through the fiber bundle to be conveyed, the method comprising the step of:

repeatedly performing a fluctuating operation of moving a contact member in a direction inclined at least with respect to a conveyance direction while rotating the contact member and bringing the contact member into contact with the fiber bundle to be conveyed so as to push a part of the fiber bundle into a stress state, and then separating the contact member from the fiber bundle in the stress state so as to temporarily bring the fiber bundle into a relaxed state, wherein, when an arbitrary spot of the fiber bundle is conveyed in a passage region of the fluid, at least one session of the fluctuating operation is performed.

2. The method for opening a fiber according to claim 1, wherein an angle between a moving direction of a contact surface of the contact member and a running direction of the fiber bundle at a moment the contact member is brought into contact with the fiber bundle is set to an angle smaller than 90 degrees.

3. The method for opening a fiber according to claim 1, wherein when the contact member moves in contact with the fiber bundle, a contact portion moves at a speed faster than a speed at which the fiber bundle runs.

4. The method for opening a fiber according to claim 1, wherein, the fluctuating operation is performed on the fiber bundle in the passage region of the fluid.

5. The method for opening a fiber according to claim 4, wherein, the passage regions are set at a plurality of spots in a conveying path of the fiber bundle.

6. The method for opening a fiber according to claim 5, wherein, the contact member is operated by adjusting contact timing of a plurality of the contact members disposed corresponding to the passage region.

7. A device for opening a fiber bundle comprising:

a conveying portion for pulling out a fiber bundle from a yarn feeding body and conveying the fiber bundle in a fiber length direction;

a fiber-opening processing portion for opening the fiber bundle by moving a fiber in a width direction while bending the fiber by letting a fluid pass through the fiber bundle to be conveyed;

a movable contact member; and a fluctuation imparting portion for moving the contact member in a direction inclined at least with respect to a conveyance direction while rotating the contact member and bringing the contact member into contact with the fiber bundle to be conveyed so as to push a part of the fiber bundle into a stress state and then, separating the contact member from the fiber bundle in the stress state so as to temporarily bring the fiber bundle into a relaxed state, wherein, the fluctuation imparting portion performs at least one session of the fluctuating operation when an arbitrary spot of the fiber bundle is conveyed in a passage region of the fluid.

8. The device for opening a fiber bundle according to claim 7, wherein a rotating shaft is provided in the contact member.

9. The device for opening a fiber bundle according to claim 7, wherein contact surfaces in contact with the fiber bundle to be conveyed are formed at a plurality of spots in the contact member.

10. The device for opening a fiber bundle according to claim 7, wherein the fluctuation imparting portion is disposed in the fiber-opening processing portion.

11. The device for opening a fiber bundle according to claim 7, wherein the contact member includes a width regulating portion for regulating a width of the fiber bundle to be conveyed.

* * * * *